US005911844A

United States Patent [19]

Benedyk

[11] Patent Number: 5,911,844

[45] **Date of Patent: *Jun. 15, 1999**

[54] METHOD FOR FORMING A METALLIC MATERIAL

[75] Inventor: Joseph C. Benedyk, Lake Zurich, Ill.

[73] Assignee: Alumax Extrusions Inc., West Chicago, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/803,763

[22] Filed: Feb. 21, 1997

Related U.S. Application Data

[60] Provisional application No. 60/012,306, Feb. 23, 1996.

[51] Int. Cl.[6] ..... C22F 1/00

[52] U.S. Cl. ..... 148/688; 148/689; 148/695; 148/696; 148/512; 148/523; 148/526; 148/574; 148/639; 148/643; 148/644

[58] Field of Search ..... 148/688, 689, 148/695, 696, 512, 523, 526, 574, 639, 643, 644

[56] References Cited

U.S. PATENT DOCUMENTS

| | | | |
|---|---|---|---|
| 3,852,990 | 12/1974 | Sparling | 72/342 |
| 4,766,664 | 8/1988 | Benedyk | 148/526 |
| 5,458,393 | 10/1995 | Benedyk | 296/203 |

*Primary Examiner*—Patrick Ryan
*Assistant Examiner*—M. Alexandra Elve
*Attorney, Agent, or Firm*—Factor and Shaftal

[57] ABSTRACT

A method for drawing a portion of metallic material having a known hardness. The method includes the step of applying a localized heat treatment to predetermined portions of the metallic material. Additionally, the method comprises forming the localized heat treated regions into a desired drawn or stamped configuration, wherein the configuration is substantially devoid of cracks.

12 Claims, 1 Drawing Sheet

Fig 1
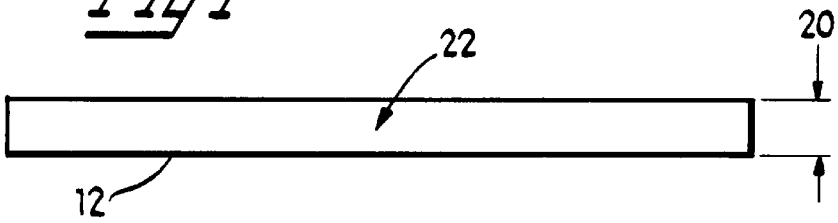
Fig 2
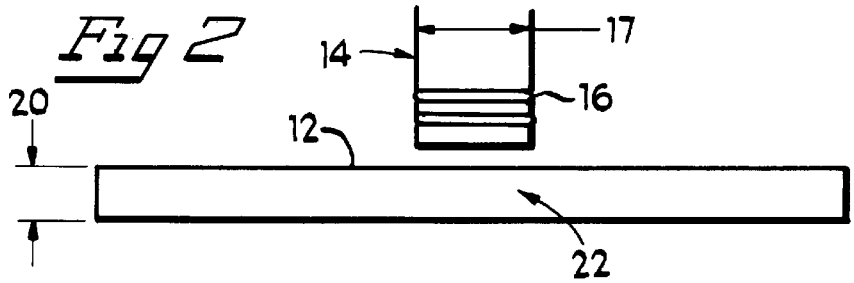
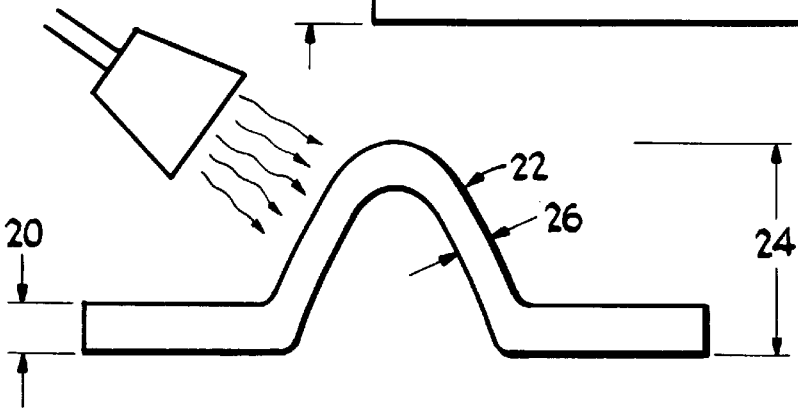
Fig 3
Fig 4
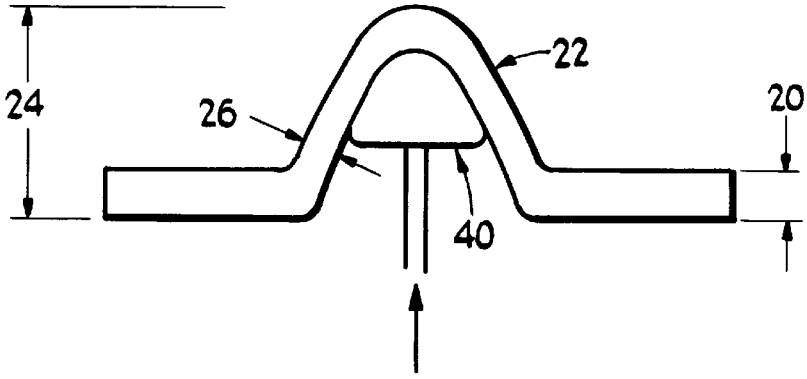
Fig 5
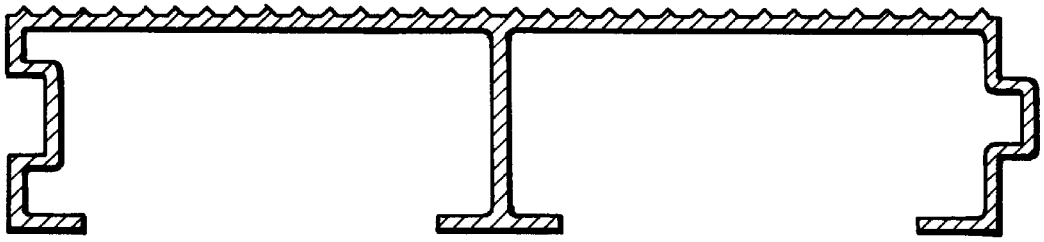

METHOD FOR FORMING A METALLIC MATERIAL

This application depends from, and claims priority of, U.S. Provisional application Ser. No. 60/012,306 filed Feb. 23, 1996.

BACKGROUND OF THE INVENTION

1. Field of the Invention

The present invention is directed to the forming of a material, and more particularly, to a process for drawing or stamping predetermined portions of a material which has been subjected to a localized heat treatment ("retrogression heat treatment") method.

2. Background Art

The forming of a metallic material/metal into a desired shape, by drawing or stamping has been known in the art. With some metallic materials, such an operation often times disrupts the structural integrity of the metallic material. Indeed, many metals and alloys have unstable tempers, which do not lend themselves to stamping/drawing. Thus, it has been standard practice to use only metals of certain stable tempers for such operations.

For instance, in the sheet metal industry, stable, age hardened materials (such as alloys with stabilized -T4 tempers) or fully annealed materials are used in order to achieve maximum formability in stamping or drawing operations. While such materials have been useful, in many applications it is desirous to use an even harder alloy, such as an aluminum alloy having -T6 temper properties.

In particular, unsatisfactory results have been observed with the drawing/stamping of many types of aluminum alloys (not to mention other metallic materials). For example, a -T4 temper aluminum alloy material is desirable from a ductility and strength standpoint for use in stamping operations. One such advantage is that it does not need to be solution annealed in order to be able to approach stronger -T6 temper properties in the finished components) (the -T4 temper materials need only be aged at moderate temperatures for short periods of time to achieve near or full -T6 temper properties). However, there are drawbacks to using an unstable -T4 temper material in stamping operations inasmuch as the -T4 temper is long-term unstable. Due to its instability, if a -T4 temper material is used to make a component (through a drawing or stamping process) the drawn/stamped region can develop cracks during the drawing operation, and would, if readily formable, be desirous for use in many applications. As such, the component is defective and unusable.

On the other hand, a -T5 or a -T6 temper aluminum alloy is stable. However, it is difficult to draw or stamp such a material. Indeed, the material is generally too brittle to permit forming through such processes. As such, if any drawing or stamping is attempted with such a material, the material quickly deteriorates and cracks develop. Thus, this material is likewise unsuitable for any such processes.

It is thus an object of the present invention to provide a method for stamping or drawing hard metallic materials which are conventionally deemed unacceptable for such stamping or drawing.

It is also an object of the present invention to draw or stamp such metallic materials at predetermined regions, wherein the predetermined regions have stretched (or drawn) areas having depths greater than conventionally obtainable—without the formation of any visually observable cracking in the stretched/drawn areas.

These and other objects of the present invention will become apparent in light of the present Specification, Claims and Drawings.

SUMMARY OF THE INVENTION

The present invention comprises a method for forming a portion of a metallic material having a known hardness. The method comprises the steps of heat treating, forming and hardening. The step of heat treating softens a localized region of the metallic material and the step for forming forms at least a portion of the localized heat treated region into a desired drawn or stamped configuration—wherein the configuration is substantially devoid of cracks. The step of hardening hardens the localized heat treated region back toward (and even beyond) the known hardness of the metallic material as it had existed prior to heat treatment.

In a preferred embodiment of the invention, the heat treating step includes the step of applying retrogression heat treatment to the localized region of the metallic member for a predetermined period of time.

In another preferred embodiment, the method includes the step of quenching the localized heat treated region of the metallic material with a fluid medium, such as water and/or oil, or in air. The method may alternatively include the step of solution annealing the metallic material at a predetermined temperature for a predetermined period of time. In addition, it is also contemplated that hardening occurs through a natural and/or artificial aging process.

In a preferred embodiment, the metallic material used as a work piece comprises an aluminum alloy, such as an age hardenable aluminum alloy. Such a metallic material may comprise an extrusion, mill product, or a casting.

BRIEF DESCRIPTION OF THE DRAWINGS

FIG. 1 of the drawings is a side elevational view of a piece of metallic material;

FIG. 2 of the drawings is a side elevational view of the metallic material undergoing the localized heat treating step of the present invention;

FIG. 3 of the drawings is a side elevational view of the metallic material undergoing the hardening step;

FIG. 4 of the drawings is a cross-sectional view of the metallic material undergoing ball testing after the heat treating step; and FIG. 5 of the drawings is a cross-sectional view of a particular flooring, which material formed the basis for the testing and experimentation.

DETAILED DESCRIPTION OF THE INVENTION

While this invention is susceptible of embodiment in many different forms, there is shown in the drawings and will herein be described in detail, one specific embodiment with the understanding that the present disclosure is to be considered as an exemplification of the principles of the invention and is not intended to limit the invention to the embodiment so illustrated.

Metallic material 12 is shown in its pre-drawn condition in FIGS. 1 and 2, as comprising localized region 22 and thickness 20. While thickness 20 is shown to be uniform, it is also contemplated that thickness 20 may comprise a non-uniform thickness. Likewise, it is contemplated that the metallic material comprise any metal element or alloy thereof. For example, and as will be described for purposes of explanation of the invention only, the metallic material may comprise any one of a -T6 temper alloy (such as 6061-T6), or a -T5 temper alloy (such as 6105-T5). Again, it will be readily understood to those with ordinary skill in the art, having the present disclosure before them, that other aluminum alloys, as well as other metals and alloys thereof, are likewise contemplated for use. Moreover, it will be understood that the metallic material, rolled sheet or strip, may comprise an extruded material and/or a cast material, among others.

Metallic material 12 is shown in its post-drawn condition in FIG. 4, wherein localized region 22 further includes height 24 and dome thickness 26. Localized region 22 comprises the area of metallic material 12 that has been formed through, for example, a drawing process. While a bell shaped resulting localized region is shown, it is of course contemplated that virtually any shape may be drawn, stamped or formed, depending on the desired final shape dimensions of the particular product.

As shown in FIG. 2 through FIG. 4, the method for drawing (or stamping) a metallic material comprises several steps. Initially, to draw, stamp or otherwise form metallic material 12, the metallic material must first undergo a localized heat treatment, to, among other things, soften localized region 22. While other heat treatments are contemplated, a retrogression heat treatment may be utilized. A full explanation of the retrogression heat treatment is disclosed in U.S. Pat. No. 5,458,393, which was invented by the present inventor, and incorporated herein by reference.

More specifically, metallic material 12 is introduced to induction heating unit 14. The induction heating unit includes coils 16 which are wound about diameter 17. One such commercially available unit is the LEPEL LSS-2.5 KW induction heating unit (available from LEPEL Company of Edgewood, N.Y.). For proper positioning of the metallic material relative to induction heating unit 14, localized region 22 is positioned below coils 16 at a predetermined distance. The optimal initial distance between localized region 22 and coils 16 may be determined through experimentation or through mathematical modeling and computation.

Once properly positioned, retrogression heat treatment unit 14 locally heat treats region 22 of metallic material 12. As the heat treating continues, the distance between localized region 22 and coils 16 may be varied. The step of heat treatment continues for a given predetermined time period, or, alternatively, until the localized region has reached a predetermined temperature. After attaining a given temperature within a time period that provides for adequate softening, the work piece is quenched to room temperature. The quenching process may include water quenching or other fluid quenching, such as oil or air. At the end of the localized heat treatment step, the localized region of the metallic material will be substantially softened and ductility will have substantially increased as well.

After heat treating, metallic material 12 is positioned in forming apparatus 40, which may comprise a drawing machine. Once properly positioned, localized heat treated region 22 of metallic material 12 is then drawn/shaped in forming apparatus 40 into the desired shape. As noted, while the invention is described with respect to drawing, other processes are likewise contemplated. Accordingly, it is contemplated that forming apparatus 40 may alternatively comprise any one of a variety of material forming machines, including, but not limited to, a punch press, a stamping press and a forging press.

After forming, the shaped component is subjected to hardening by natural or artificial aging. The hardening that results may approach or exceed the original hardness of the workpiece material.

In support of the ability to draw/stamp various metallic materials without cracking (for metallic materials which would otherwise result in cracks) several tests were conducted in reliance upon the process of the present invention.

The first test compared drawing characteristics of different materials in a ball punch test. The ball punch test apparatus was a conventional GRIES Model 131 test machine using a 0.873" diameter ball, a 1.110" diameter ring and a 500 kg clamping force. A ball punch test pushes a "ball" under considerable force into a specimen, creating a dome-like deformation in the specimen. The resulting dome-like deformation heights are measured, and from these measurements, the material with the best formability characteristics can be determined.

In such a test, three aluminum alloy specimens, including a 6061-T4 alloy and two 6061-T6 alloy materials were compared. The material specimens comprised 2.68 inch diameter blanks punched out from a ribbed flooring extrusion. (The full extrusion cross-section from which the blanks were prepared can be seen in FIG. 5.)

One of the two 6061-T6 specimens underwent the above-described method for facilitating drawing. The procedure was carried out using a conventional LEPEL LSS-2.5 KW induction heating unit equipped with a water cooled copper coil configured as a flat spiral of approximately 2.2 inch diameter with four internal turns. The coil was positioned over the blank with an air gap of approximately 0.056". This air gap increased by about 0.040" when power was provided to the coils. At the maximum power setting for the induction heating unit, the coil-blank system was tuned so that the measured initial power reading was 60–62% of maximum (63% voltage, 75% frequency and 92% amperage). This value rose to about 70% during the set heating time of 25–35 seconds. The treated 6061-T6 specimen, was then water quenched immediately before the ball punch test (which is described in detail below). The measured hardness of the treated specimen dropped from the initial -T6 hardness of 15 $W_B$ to about 4–5 $W_B$.

The treated 6061-T6 specimen, the non-treated 6061-T6 and the 6061-T4 were each positioned in the ball punch test machine and underwent the above-described ball punch test. Subsequently, the dome-like formation height was measured for each of the specimens. The test was repeated three times for each material, and, the results are reproduced in Table I below:

TABLE I

| Material | Maximum Cup Height (inches) (3 trials) |
|---|---|
| 6061-T4 | 0.469, 0.498, 0.484 |
| 6061-T6 | 0.152, 0.134, 0.188 |
| 6061-T6 (Retrogression Heat Treated) | 0.554, 0.544, 0.594 |

Accordingly, the results confirmed that the dome height of the retrogression heat treated 6061-T6 far exceeded the non-retrogression heat treated 6061-T6, and, the dome height of the 6061-T4 material. In sum, the results obtained in this test indicated that the above-described process imparts a state of enhanced formability of the treated -T6 material when compared to the 6061-T4 material, and, the non-treated -T6 material. As was observed, the treated -T6 material was formed to the desired configuration without any apparently visible cracks.

A second test was performed toward determining the optimum timing of the retrogression heating of different materials. Specimens were again made, this time of 6061-T6 aluminum and 6105-T5 aluminum, both of which materials are not readily formable. The specimens underwent the treatment similar to that of the treated 6061-T6 specimen, as described above. After treatment, the specimens underwent the same ball punch test as the specimens in the first test. Table II below illustrates the drawn dome heights obtained when the specimens were heated to different predetermined temperatures:

TABLE II

| Retrogression heating time | 6016-T6 Dome Height Inches (incl. Thickness) | 6105-T5 Dome Height Inches (Incl. Thickness) |
|---|---|---|
| 0 | 0.164 | 0.172 |
| 40 | 0.172 | 0.567 |
| 50 | 0.494 | 0.545 |
| 60 | 0.526 | 0.605 |
| 70 | 0.568 | 0.613 |
| 80 | 0.605 | 0.591 |
| 90 Material near melting point, cracked upon quenching | 0.359 | ~ |

From the results of the second test, it can be observed that the specimens showed a higher dome height with retrogression heat treatment and that generally, an increase in retrogression heating times results in a greater dome height. Additionally, the test showed that as each material approaches its melting point, its formability is compromised and maximum formability is achieved at a given retrogression heat treatment cycle.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A method for forming at least a portion of metallic material having a known hardness corresponding to one of a -T5 or -T6 temper, comprising the steps of:

heat treating, and, in turn softening at least one localized region of the metallic material, wherein the at least one localized region is softened to at least a -T4 temper;

quenching the localized heat treated region of the metallic material with a fluid medium;

forming at least a portion of the localized heat treated region after quenching into a desired drawn or stamped configuration wherein the drawn or stamped configuration is substantially devoid of cracks; and age hardening the localized heat treated region, and, in turn, the drawn or stamped configuration, back towards its pre-softened hardness.

2. The method for forming a portion of metallic material according to claim 1 wherein the step of heat treating further includes the step of:

quenching the localized heat treated region of the metallic material with a fluid medium.

3. The method for forming a portion of metallic material according to claim 2 wherein the fluid medium comprises water.

4. The method for forming a portion of metallic material according to claim 3 wherein the fluid medium comprises oil.

5. The method for forming a portion of metallic material according to claim 1 wherein the step of heat treating comprises the step of:

applying retrogression heat treatment to the localized region of the metallic material for a predetermined period of time.

6. The method for forming a portion of metallic material according to claim 5 wherein the step of applying retrogression heat treatment includes the step of:

solution annealing the metallic material at a predetermined temperature for a predetermined period of time.

7. The method for forming a portion of metallic material according to claim 1 wherein the metallic material comprises an aluminum alloy.

8. The method for forming a portion of metallic material according to claim 1 wherein the metallic material comprises an extrusion.

9. The method for forming a portion of metallic material according to claim 1 wherein the metallic material comprises a casting.

10. The method for forming a portion of metallic material according to claim 1 wherein the metallic material comprises a mill product.

11. The method for forming a portion of metallic material according to claim 1 wherein the metallic material includes a substantially uniform cross-section.

12. The method for forming a portion of metallic material according to claim 1 wherein the metallic material includes a variable cross-section.

* * * * *